US009803836B1

(12) United States Patent
Harpenau et al.

(10) Patent No.: US 9,803,836 B1
(45) Date of Patent: Oct. 31, 2017

(54) DECORATIVE SKIN FOR SURFACE MOUNT LIGHT FIXTURE

(71) Applicants: Kevin Roy Harpenau, Peachtree City, GA (US); Russell Bryant Green, Douglasville, GA (US)

(72) Inventors: Kevin Roy Harpenau, Peachtree City, GA (US); Russell Bryant Green, Douglasville, GA (US)

(73) Assignee: Cooper Technologies Company, Houston, TX (US)

( * ) Notice: Subject to any disclaimer, the term of this patent is extended or adjusted under 35 U.S.C. 154(b) by 251 days.

(21) Appl. No.: 14/702,555

(22) Filed: May 1, 2015

(51) Int. Cl.
*F21V 19/00* (2006.01)
*F21V 17/10* (2006.01)

(52) U.S. Cl.
CPC ..... *F21V 17/101* (2013.01)

(58) Field of Classification Search
CPC ..... F21S 8/026; F21S 8/03; F21S 8/04; F21V 2/02; F21V 2/041
See application file for complete search history.

(56) References Cited

U.S. PATENT DOCUMENTS 5,690,424 A * 11/1997 Warshauer ..... F21S 8/06 362/294
7,722,227 B2 * 5/2010 Zhang ..... F21S 8/026 362/147
7,810,960 B1 * 10/2010 Soderman ..... F21K 9/00 362/249.02
7,950,832 B2 * 5/2011 Tanaka ..... F21V 5/04 362/311.02
2008/0232116 A1 * 9/2008 Kim ..... F21S 8/026 362/365
2008/0285271 A1 * 11/2008 Roberge ..... F21S 8/033 362/235

OTHER PUBLICATIONS

This Week at Cold Comfort: LED Ceiling Lights. Feb. 2, 2012. pp. 1-14 www.coldcomfortmicrofarm.blogspot.com/2012/led-ceiling-lights.html.
Ultra Light Disk LED. Recessed and Surface Mount Downlight Kit. Sylvania. www.sylvania.com/ledretrofit. Feb. 15.
T67/Commercial Electric 6 In. Recessed Soft White LED Disk Light. Jan. 21, 2013. http://www.amazon.com/commercial-electric-recessed-white-light/dp/boob3xIIMK.

* cited by examiner

*Primary Examiner* — Ali Alavi
(74) *Attorney, Agent, or Firm* — King & Spalding LLP

(57) ABSTRACT

In an example embodiment of the present disclosure, a light fixture assembly comprises a surface mount light fixture. The surface mount light fixture comprises a trim having a first shape. The trim comprises an outer trim perimeter and an inner trim perimeter. The inner trim perimeter defines an orifice through which light is emitted, wherein the outer trim perimeter includes a chamfered edge. The light fixture assembly further includes a skin having a second shape similar to the first shape and configured to at least partially cover the trim. The skin includes an outer skin perimeter configured to surround the outer trim perimeter, an inner skin perimeter configured to surround the inner skin perimeter, and a raised coupling feature configured to grip the chamfered edge of the trim. The skin is coupled to the trim via the engagement of the raised coupling feature and the chamfered edge.

20 Claims, 2 Drawing Sheets

DECORATIVE SKIN FOR SURFACE MOUNT LIGHT FIXTURE

TECHNICAL FIELD

Embodiments of this disclosure relate generally to decorative elements of surface mount light fixtures, and more particularly to an add-on decorative skin for changing the color of surface mount light fixtures.

BACKGROUND

Many surface mount or flush mount light fixtures include a visible exterior trim. Due to differences in wall color, décor, and customer taste, it would be desirable to provide the light fixtures in various trim colors. For example, some customers may prefer white or cream colors to blend in with the color of the wall or ceiling. Other customers may prefer metallic colors such as satin nickel or bronze. However, providing light fixtures of a range of colors would increase the number of SKUs and require increased inventory. Thus, it would be advantageous to provide a means of customizing the color of a surface mount or flush mount light fixture. One prior art approach to attempting to provide this customization involves using covers or skins that fit over the light fixture. However, prior art skins have been lacking in that they can interfere with the mounting of the light fixture. Accordingly, an improved skin for a light fixture is needed.

SUMMARY

In an example embodiment of the present disclosure, a light fixture assembly comprises a surface mount light fixture. The surface mount light fixture comprises a trim having a first shape. The trim comprises an outer trim perimeter and an inner trim perimeter. The inner trim perimeter defines an orifice through which light is emitted, wherein the outer trim perimeter includes a chamfered edge. The light fixture assembly further includes a skin having a second shape similar to the first shape and configured to at least partially cover the trim. The skin includes an outer skin perimeter configured to surround the outer trim perimeter, an inner skin perimeter configured to surround the inner trim perimeter, and a raised coupling feature configured to grip the chamfered edge of the trim. The skin is coupled to the trim via the engagement of the raised coupling feature and the chamfered edge.

In another example embodiment of the present disclosure, a surface mount light fixture includes a skin. The skin comprises an outer skin perimeter, an inner skin perimeter, and one or more surfaces defined therebetween. The inner skin perimeter defines an opening through which light is can be emitted, and the one or more surfaces are contoured correspondingly to an outer surface of a surface mount light fixture. The skin further includes a coupling feature formed on the skin configured to couple the skin to the surface mount light fixture.

In another example embodiment of the present disclosure, a light fixture assembly includes a light fixture. The light fixture includes a trim having a first shape. The trim includes an outer trim perimeter and an inner trim perimeter, the inner trim perimeter defining an orifice through which light is emitted. The trim also includes a retainment feature formed on the outer trim perimeter, the inner trim perimeter, or anywhere therebetween. The light fixture assembly includes a skin having a second shape similar to the first shape and configured to at least partially cover the trim. The skin comprises an outer skin perimeter configured to surround the outer trim perimeter, an inner skin perimeter configured to surround the inner trim perimeter, and a coupling feature configured to engage with the retainment feature of the trim. The skin is coupled to the trim via the engagement of the coupling feature and the retainment feature.

BRIEF DESCRIPTION OF THE DRAWINGS

Reference will now be made to the accompanying drawings, which are not necessarily drawn to scale, and wherein.

DETAILED DESCRIPTION OF EXAMPLE EMBODIMENTS

Figure 1:
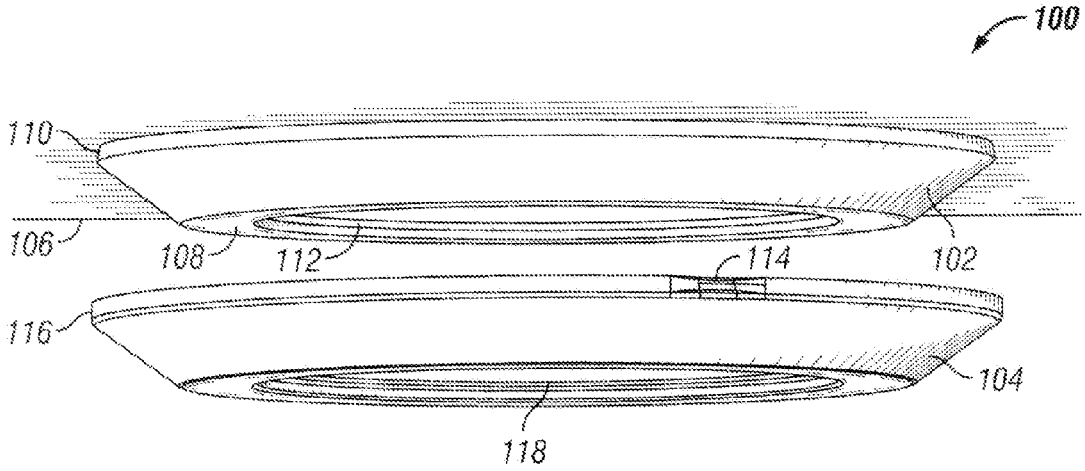
FIG. 1 illustrates an exploded view of a light fixture assembly, in accordance with example embodiments of the present disclosure.

The example embodiments discussed herein are directed to skins for surface mount light fixtures. The example embodiments are better understood by reading the following description of non-limiting, example embodiments with reference to the attached drawings, wherein like parts of each of the figures are identified by like reference characters, and which are briefly described as follows. In the following detailed description of the example embodiments, numerous specific details are set forth in order to provide a more thorough understanding of the disclosure herein. However, it will be apparent to one of ordinary skill in the art that the example embodiments disclosed herein may be practiced without these specific details. In other instances, well-known features have not been described in detail to avoid unnecessarily complicating the description.

Turning to the figures, FIG. 1 illustrates an exploded view of a light fixture assembly 100, in accordance with example embodiments of the present disclosure. The light fixture assembly 100 includes a surface mount light fixture 102 and a skin 104. In certain example embodiments, the light fixture 102 is mounted to a ceiling 106. The light fixture 102 includes an outer heat sink 108 that also acts as a trim of the light fixture 102. In certain example embodiments, the heat sink (also referred to as the trim) 108 is defined by an outer perimeter 110 and an inner perimeter 112. The inner perimeter 112 defines an area through which light is emitted from the light fixture 102. In certain example embodiments, the heat sink 108 has a circular shape. In certain other example embodiments, the heat sink 108 can have a rectangular shape, an oval shape, or any other polygonal, regular, or irregular shape.

Figure 2:
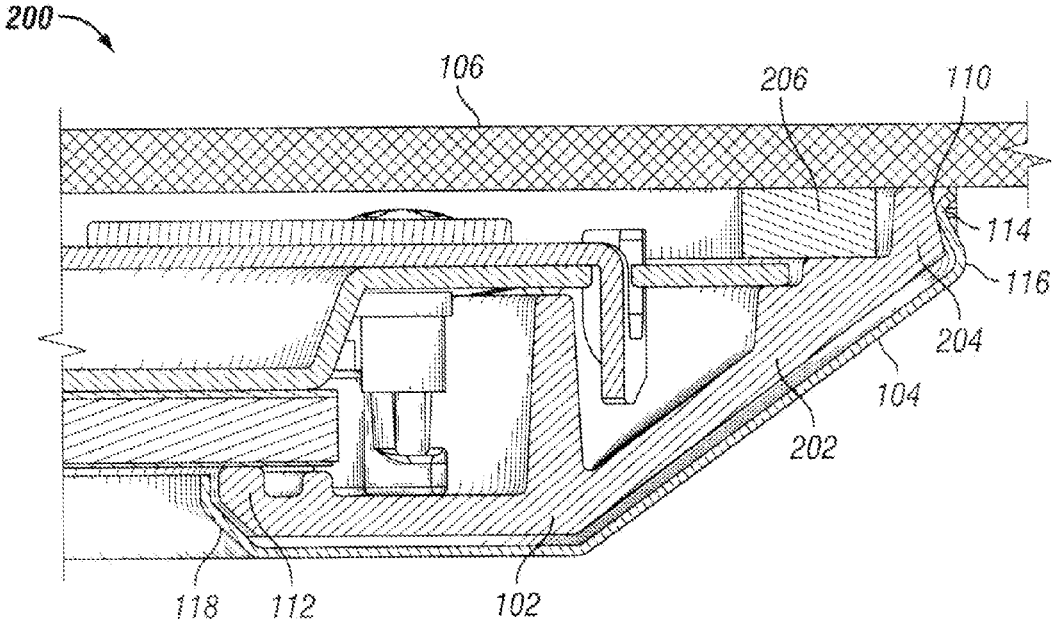
FIG. 2 illustrates a cross-sectional view of the light fixture assembly of FIG. 1, in which a skin is attached to a light fixture, in accordance with example embodiments of the present disclosure.

FIG. 2 illustrates a cross-sectional view 200 of the light fixture assembly 100 in which the skin 104 is attached to the light fixture 102, in accordance with example embodiments of the present disclosure. Referring to FIGS. 1 and 2, in certain example embodiments, the light fixture assembly 100, and specifically the heat sink 108, has a slanted profile 202. In certain example embodiments, the heat sink 108 further includes a chamfered edge 204 at the outer perimeter 110 of the heat sink 108. The chamfered edge 204 is angled inward from the slanted profile 202. In certain example embodiments, the chamfered edge 204 encircles the entire outer perimeter 110. In other example embodiments, the chamfered edge 204 is located in a plurality of distinct locations around the outer perimeter 110. The chamfered edge 204 is one example of a retainment feature for coupling to the skin 104. The heat sink 108 or light fixture 102 can have various other retainment features that correspond to various coupling features of the skin 104. For example, the heat sink 108 or the light fixture 102 can have a step feature or curved feature that serves as the retainment feature. In certain example embodiments, the light fixture 102 includes a gasket 206 disposed at least partially between the heat sink 108 and the ceiling 106. The gasket 206 seals the inside of the light fixture 102 against moisture and debris.

In certain example embodiments, the skin 104 is a hard cover configured to cover the heat sink 108. In certain example embodiments, the skin 104 has a shape and profile which corresponds to the shape and profile of the heat sink 108. Specifically, the skin 104 has an outer perimeter 116 and an inner perimeter 118 configured to conform to the outer perimeter 110 and inner perimeter 112 of the heat sink 108 so that the skin 104 completely covers the heat sink (or trim) 108 such that the heat sink 108 is not visible to a person looking up at the surface mount light fixture 102. In certain example embodiments, the skin 104 is fabricated from a metal or plastic material and is shaped to provide a thin cover to the heat sink 108. In certain example embodiments, the skin 104 includes a covered coating. The coating may be matte, glossy, metallic, or any other type of finish.

In certain example embodiments, the skin 104 includes one or more attachment features (also referred to as coupling features) 114 for coupling the skin 104 to the heat sink 108. In certain example embodiments, the attachment feature 114 is a retention bump 114 formed on the outer perimeter 116 of the skin 104. In certain example embodiments, the retention bump 114 is a portion of the outer perimeter 116 that protrudes inwards. In certain example embodiments, when the skin 104 is pushed onto the heat sink 108, the retention bumps 114 engage with the chamfered edge 204 of the heat sink 108 and is thereby retained on the heat sink 108. In certain example embodiments, the skin 104 includes three retention bumps 114 disposed at equal intervals around the outer perimeter 116 of the skin 104.

In certain example embodiments, the skin 104 and the heat sink 108 include various other types of coupling features for coupling the skin 104 to the heat sink 108. In certain example embodiments, the skin 104 includes a plurality of spherical bumps. The spherical bumps can be made by creating a spherical indention in the material of the skin 104 at the outer perimeter 116 or by affixing a spherical bump pad to the skin 104. The spherical bumps are similarly retained by the chamfered edge 204 of the heat sink 108. In certain other example embodiments, the skin 104 includes one or more inward facing edged tabs and the heat sink 108 includes one or more corresponding slots for receiving the tabs and retaining the skin 104. In certain example embodiments, the skin 104 can be coupled to the heat sink 108 magnetically, via various male-female connections (e.g., tab/slot), or via adhesives. In certain example embodiments, such retainment features can be located in any corresponding locations of the skin 104 and the heat sink 108, including on the inner perimeter 112 of the heat sink 108 and the inner perimeter 118 of the skin 104.

One advantage of the example retainment features and attachment features described herein is that they do not interfere with the gasket 206 and therefore do not disrupt the seal between the light fixture and the ceiling. Another advantage is that the example retainment features and attachment features do not create an unwanted gap between the ceiling and the fixture.

Figure 3:
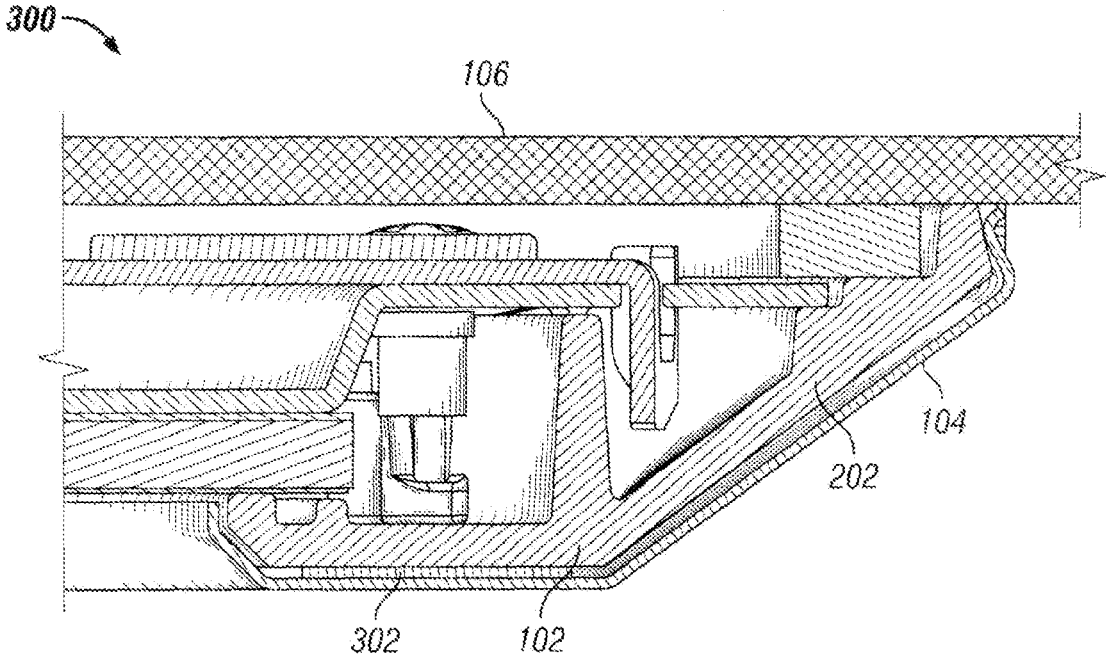
FIG. 3 illustrates a cross-sectional view of a light fixture assembly in which the skin is attached to the light fixture via adhesive, in accordance with example embodiments of the present disclosure.

FIG. 3 illustrates a cross-sectional view of a light fixture assembly 300 in which the skin 104 is attached to the light fixture 102, in accordance with example embodiments of the present disclosure. In certain example embodiments, the skin 104 includes a layer of double sided adhesive 302, such as a double sided tape or pad. The adhesive 302 is disposed between two corresponding surfaces of the skin 104 and the heat sink 108. The skin 104 is thereby coupled to the heat sink 108.

The skin 104, when coupled to the heat sink 108, covers up the heat sink 108 and provides an exterior trim for the light fixture 100. In certain example embodiments, the skin 104 is permanently coupled to the heat sink 108. In certain other example embodiments, the skin 104 is removably coupled to the heat sink 108 and thus interchangeable.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A light fixture assembly, comprising:

a light fixture comprising:

a trim having a first shape, the trim comprising:

an outer trim perimeter and an inner trim perimeter, the inner trim perimeter defining an orifice through which light is emitted; and a retainment feature formed on the outer trim perimeter, the inner trim perimeter, or anywhere therebetween;

a skin having a second shape similar to the first shape and configured to at least partially cover the trim, the skin comprising:

an outer skin perimeter configured to surround the outer trim perimeter;

an inner skin perimeter configured to surround the inner trim perimeter; and a coupling feature configured to engage with the retainment feature of the trim, wherein the skin is coupled to the trim via the engagement of the coupling feature and the retainment feature.

2. The light fixture assembly of claim 1, wherein the retainment feature comprises one of a chamfered edge, a step feature, and a curved feature.

3. The light fixture assembly of claim 2, wherein the coupling feature comprises one or more bumps configured to grip the chamfered edge.

4. The light fixture assembly of claim 1, wherein the skin comprises a layer of double sided adhesive material configured to couple the skin to the trim.

5. The light fixture assembly of claim 1, wherein the skin completely covers the trim.

6. The light fixture assembly of claim 1, wherein the skin comprises a colored coating.

7. The light fixture assembly of claim 1, wherein the skin is removably coupled to the trim.

8. A skin for a surface mount light fixture, comprising:

an outer skin perimeter, an inner skin perimeter, and one or more surfaces defined therebetween, wherein the inner skin perimeter defines an opening through which light is emitted when the skin is coupled to the surface mount light fixture, and wherein the one or more surfaces are contoured correspondingly to an outer surface of the surface mount light fixture; and a coupling feature formed on the skin configured to couple the skin to the surface mount light fixture.

9. The skin for a surface mount light fixture of claim 8, wherein the coupling feature is one or more bumps formed on the outer skin perimeter.

10. The skin for a surface mount light fixture of claim 8, wherein the coupling feature is a tab formed on the skin.

11. The skin for a surface mount light fixture of claim 8, wherein the skin is fabricated from a metallic material.

12. The skin for a surface mount light fixture of claim 8, wherein the skin includes a colored coating.

13. The skin for a surface mount light fixture of claim 8, wherein the skin further comprises a layer of double sided adhesive material.

14. A light fixture assembly, comprising:

a surface mount light fixture comprising:

a trim having a first shape, the trim comprising:

an outer trim perimeter and an inner trim perimeter, the inner trim perimeter defining an orifice through which light is emitted, wherein the outer trim perimeter includes a chamfered edge;

a skin having a second shape similar to the first shape and configured to at least partially cover the trim, the skin comprising:

an outer skin perimeter configured to surround the outer trim perimeter;

an inner skin perimeter configured to surround the inner trim perimeter; and a raised coupling feature configured to grip the chamfered edge of the trim, wherein the skin is coupled to the trim via the engagement of the raised coupling feature and the chamfered edge.

15. The light fixture assembly of claim 14, wherein the skin has a circular, polygonal, or curved shape.

16. The light fixture assembly of claim 14, wherein the surface mount light fixture comprises a gasket.

17. The light fixture assembly of claim 14, wherein the skin completely covers the trim.

18. The light fixture assembly of claim 14, wherein the skin includes a colored coating.

19. The light fixture assembly of claim 14, wherein the skin further comprises a layer of double sided adhesive material.

20. The light fixture assembly of claim 14, wherein the skin comprises a plurality of raised coupling features formed in the outer skin perimeter.

* * * * *